US005784880A

United States Patent [19]

Toshiro et al.

[11] Patent Number: 5,784,880

[45] Date of Patent: Jul. 28, 1998

[54] ENGINE FUEL SUPPLY CONTROL DEVICE

[75] Inventors: Takayuki Toshiro, Fujisawa; Koichi Mori, Sagamihara; Kimiyoshi Nishizawa, Yokohama, all of Japan

[73] Assignee: Nissan Motor Co., Ltd., Kanagawa, Japan

[21] Appl. No.: 684,669

[22] Filed: Jul. 22, 1996

[30] Foreign Application Priority Data

Jul. 31, 1995 [JP] Japan ..... 7-195506

[51] Int. Cl.[6] ..... F01N 3/28

[52] U.S. Cl. ..... 60/277; 60/285

[58] Field of Search ..... 60/274, 277, 285, 60/276

[56] References Cited

U.S. PATENT DOCUMENTS

| | | | |
|---|---|---|---|
| 4,656,829 | 4/1987 | Creps et al. | 60/277 |
| 5,570,575 | 11/1996 | Sato et al. | 60/277 |
| 5,586,432 | 12/1996 | Huemer et al. | 60/285 |
| 5,606,855 | 3/1997 | Tomisawa | 60/277 |
| 5,622,049 | 4/1997 | Kitamura et al. | 60/285 |
| 5,649,420 | 7/1997 | Mukaihira et al. | 60/277 |

FOREIGN PATENT DOCUMENTS

| | | |
|---|---|---|
| 2-91438 | 3/1990 | Japan . |
| 7-197834 | 8/1995 | Japan . |

*Primary Examiner*—Willis R. Wolfe

*Attorney, Agent, or Firm*—McDermott, Will & Emery

[57] ABSTRACT

For an engine for which fuel supply is cut off in predetermined deceleration conditions, the catalyst temperature of a catalytic converter is inferred and the amount of intake air is measured. If the catalyst temperature is high and also the amount of intake air is great, then the cutting off of fuel supply is prohibited, and instead fuel combustion is performed under rich conditions. Since during fuel supply cut off the amount of oxygen supplied to the catalytic converter is relatively increased, and the temperature of the catalyst becomes elevated due to reaction between this oxygen and the catalyst within the catalytic converter, accordingly this increase of the catalyst temperature is prevented by prohibiting fuel supply cut off in such conditions in which elevation of the temperature of the catalyst can easily occur. A rich air/fuel ratio is not applied if the temperature of the catalyst is low or if the amount of intake air is small, and accordingly the danger of misfiring, which in these circumstances is invited by a rich air/fuel ratio, is avoided.

5 Claims, 4 Drawing Sheets

ENGINE FUEL SUPPLY CONTROL DEVICE

FIELD OF THE INVENTION

This invention relates to a fuel supply control device for an internal combustion engine, and more particularly relates to fuel supply control during deceleration.

BACKGROUND OF THE INVENTION

During deceleration of an internal combustion engine for an automobile, it has generally been practiced to cut off the fuel supply in order to improve fuel economy.

However, when the supply of fuel is cut off during deceleration, the air which is sucked into the combustion chambers is expelled to the exhaust passage, and the amount of oxygen supplied to a catalytic converter midway along the exhaust passage is increased. As a result, the oxidation reaction of the uncombusted fuel inside the catalytic converter increases sharply, which causes the catalyst temperature to rise sharply, and this may entail degradation of the performance of the catalyst and deterioration of the catalyst bed.

In this connection, there is disclosed in Tokkai Hei 2-91438 published by Japanese Patent Office in 1990, the concept of preventing elevation of the catalyst temperature by operating the engine at a lean air/fuel ratio instead of cutting off the fuel supply.

However, in an operational environment in which the catalyst temperature can easily become elevated, such as during engine operation at high speed and high load, the problem arises of the excess air entailed by the lean air/fuel ratio combining with the rhodium (Rh) in the catalyst, so that the capability of the catalyst for exhaust purification becomes deteriorated over time.

In this connection, Tokkai Hei 7-197834 published by Japanese Patent Office, which was filed in the Japanese Patent Office on Jul. 31, 1995 which is the priority date of the present application but was laid open by Japanese Patent Office on Aug. 1, 1995 which is after the priority date of this application, discloses the concept of controlling the supply of fuel so as not to cut off the supply of fuel even during deceleration if the catalyst temperature is high, and to keep the air/fuel ratio rich. By enriching the air/fuel ratio, it is possible to restrain the oxidation reaction of the uncombusted fuel inside the catalytic converter due to oxygen in the exhaust, and thereby to prevent undue increase in the temperature of the catalyst.

In this state the throttle is completely closed since the vehicle is being decelerated, and air is supplied to the engine via a supplementary air passage which bypasses the throttle. However, if this supplementary air control valve fails, or if its performance becomes unstable, the amount of intake air may become insufficient. If as a result the standard charging efficiency is not attained, then the operational performance of the engine may deteriorate, the fuel combustion in the engine may become unstable, and misfiring may easily occur.

SUMMARY OF THE INVENTION

It is therefore an object of this invention to prevent deterioration of the catalyst when fuel cut off takes place during deceleration as well as to ensure stable combustion in the engine even when the amount of intake air is greatly reduced.

In order to achieve the above object, This invention provides a fuel supply control device for such an engine that has an intake passage, an exhaust passage, a catalytic converter having a catalyst provided in the exhaust passage, and a mechanism for supplying fuel. The device comprises a mechanism for cutting off supply of fuel by the fuel supplying mechanism in a predetermined engine deceleration condition, a mechanism for inferring a value for a temperature of the catalyst, a mechanism for detecting an air flow amount in the intake passage, a mechanism for comparing together a value indicative of the inferred catalyst temperature and a previously set first constant value, a mechanism for comparing together the air flow amount in the engine deceleration condition and a previously set second constant value, and a mechanism for prohibiting fuel supply cut off by the fuel supply cut off mechanism when the value indicative of the inferred catalyst temperature is greater than said first constant value and also said intake air amount is greater than said second constant value.

It is preferable that the device further comprises a mechanism for determining whether or not fuel cut off has been performed after the deceleration has started, and a mechanism for, if fuel cut off has been performed after the deceleration has started, stopping the prohibition of fuel supply cut off by the prohibiting mechanism until the end of deceleration.

It is further preferable that the catalyst temperature inferring mechanism infers the catalyst temperature from an engine rotational speed and a basic fuel injection amount which is calculated based upon an engine operational condition.

It is also preferable that the catalyst temperature inferring mechanism infers the catalyst temperature before the start of engine deceleration.

It is also preferable that the device further comprises a mechanism for enriching an air/fuel ratio of air-fuel mixture which is supplied to the engine to be richer than a stoichiometric air/fuel ratio, when the value indicative of the inferred catalyst temperature is greater than the first constant value and also the value indicative of the intake air amount is greater than the second constant value.

The details as well as other features and advantages of this invention are set forth in the remainder of the specification and are shown in the accompanying drawings.

DESCRIPTION OF THE PREFERRED EMBODIMENTS

Figure 1:
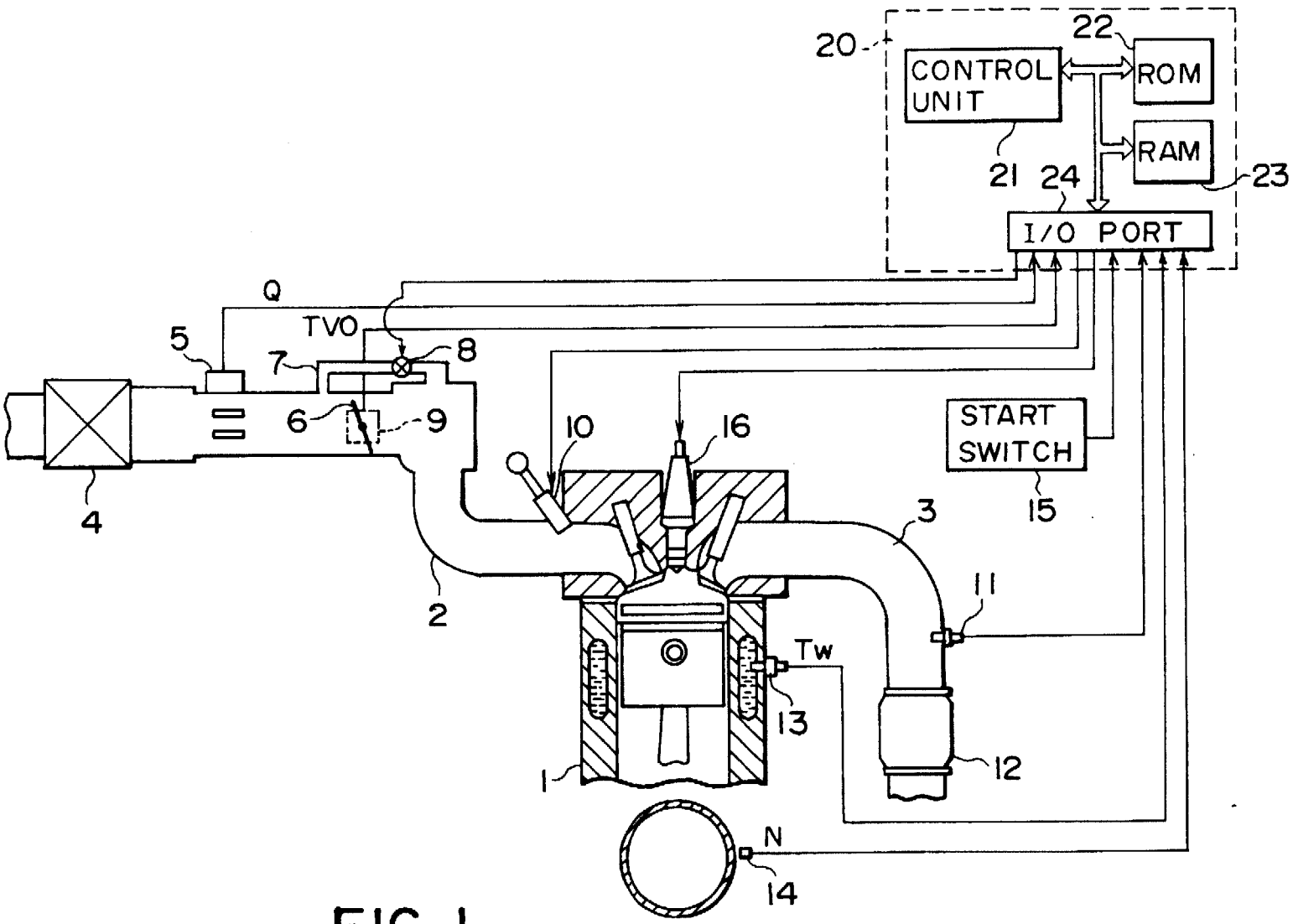
FIG. 1 is a schematic diagram of a fuel supply control device according to this invention.

Referring to FIG. 1 of the drawings, a multi cylinder engine 1 for an automobile comprises an intake passage 2 and an exhaust passage 3. In the intake passage 2 there are provided an air cleaner 4, an air flow meter 5, a throttle valve 6, and a supplementary air conduit 7 which bypasses the throttle valve 6.

The air flow meter 5 detects the flow amount Q of air through the intake passage 2 and outputs a signal representative thereof to a control unit 20. The operation of the throttle valve 6 is linked to that of an accelerator pedal which is not shown in the figures, and controls the air flow amount Q. The throttle valve 6 is equipped with a throttle sensor 9 which detects the throttle valve opening amount TVO. The throttle sensor 9 is fitted with an idle switch which detects when the throttle valve 6 is in its fully closed position. The throttle valve opening TVO and a signal which corresponds to the fully closed position of the throttle detected by the throttle sensor 9 are output to the control unit 20. The supplementary air conduit 7 is equipped with a supplementary air control valve 8 which is controlled by the control unit 20 so as to regulate the amount of intake air during deceleration when the throttle 6 is closed.

The downstream end of the intake passage 2 is formed as an intake manifold which is branched into individual intake passages which lead to each of the cylinders of the engine 1, and a fuel injection valve 10 is fitted in each branch of this intake manifold. According to an injection pulse signal which is output from the control unit 20, the fuel injection valve 10 injects fuel under pressure into the intake manifold from a fuel injection pump via a pressure regulator neither of which are shown in the figure. Further, each cylinder of the engine 1 is provided with a spark plug 16 which ignites the mixture in its combustion chamber 17 according to an ignition signal from the control unit 20.

An oxygen sensor 11 which is provided part way along the exhaust passage 3 detects the concentration of oxygen in the exhaust gas and outputs a signal representative thereof to the control unit 20. Downstream of this, there is provided a catalytic converter 12 which incorporates a three way catalyst which purifies the exhaust gases by oxidizing CO and HC therein while reducing NOx.

This three way catalyst may desirably be a honeycomb form monolithic catalyst, a metal catalyst, or of a stainless wool bed. A pellet type catalyst may also be used. This invention is, however, not to be considered as limited to the case of a three way catalyst which purifies the exhaust gases of NOx, CO, and HC at the stoichiometric air/fuel ratio; it may also be applied to the case of an oxidizing catalyst.

The engine 1 further comprises a cooling fluid temperature sensor 13 which detects the temperature Tw of the fluid in a cooling jacket of the engine and outputs to the control unit 20 a signal representative thereof, and a crank angle sensor 14 which outputs to the control unit 20 a unit crank angle signal and a reference crank angle signal in correspondence to the rotation of the crankshaft of the engine 1. The rotational speed N of the engine 1 is detected by counting this unit crank angle signal over predetermined time intervals or by calculating the period of the reference crank angle signal. Further, a start switch 15 which is provided in the interior of a body of a vehicle which is being powered by the engine 1 detects starting action for starting the engine 1, and outputs a start signal to the control unit 20.

The control unit 20 comprises a microcomputer which comprises a CPU 21, a ROM 22, a RAM 23, and an input-output port or I/O port 24.

The control unit 20 calculates a basic fuel injection amount $$Tp = \frac{K \cdot Q}{N},$$

where K is a constant, from the intake air flow amount Q derived from the signal input from the air flow meter 5, and from the engine rotational speed N based upon the output signals from the crank angle sensor 14. Further, based upon the oxygen concentration signal which is output from the oxygen sensor 11, the control unit 20 calculates an air/fuel ratio feedback correction coefficient $\alpha$ in order to bring the air/fuel ratio towards the stoichiometric air/fuel ratio, which is the target air/fuel ratio. And the control unit 20 further calculates an actual fuel injection amount $Ti = Tp \cdot \alpha \cdot COEF + Ts$ by correcting the previously described basic fuel injection amount Tp using this air/fuel ratio feedback correction coefficient $\alpha$ and also various correction coefficients COEF and/or a voltage correction amount Ts and the like, and then controls the fuel injection valve 10 based upon the value of this actual fuel injection amount Ti. Yet further, the control unit 20 outputs an ignition signal at a predetermined timing to the spark plug 16 based upon the crank units angle signal from the crank angle sensor 14, and thereby air/fuel mixture in the combustion chamber is ignited by the spark plug 16 and then burned.

Further, the control unit 20 performs fuel cut off control so as to stop fuel supply to the engine 1 during deceleration when a signal is input from the throttle sensor 9 which indicates that the throttle valve 6 is fully closed, based upon the engine rotational speed N. Also the control unit 20 infers a catalyst temperature $T_{CA}$ from the engine rotational speed N and the basic fuel injection amount Tp which it takes as being representative of engine load, using a map which it contains internally. And furthermore the control unit 20 compares this inferred catalyst temperature $T_{CA}$ with a temperature value $T_{CH}$ which is set in advance, and also compares the above described basic fuel injection amount Tp and a previously set constant value $Tp_{MF}$ which it considers to be a misfiring limit determination constant value. And, if the inferred catalyst temperature $T_{CA}$ is greater than $T_{CH}$ and also the basic fuel injection amount Tp is greater than $Tp_{MF}$, then it is considered that the catalyst has become unduly hot and also that there is no danger of misfiring even if fuel is supplied, and in these circumstances the above described fuel supply cut off is prohibited.

The above described control process which is executed by the control unit 20 will be explained using the flow chart shown in FIG. 2.

First in a step S1 the control unit 20 reads in the output signals from the various sensors described above.

In a step S2, the control unit 20 calculates the basic fuel injection amount Tp from the engine rotational speed N and the intake air flow amount Q.

Figure 3:
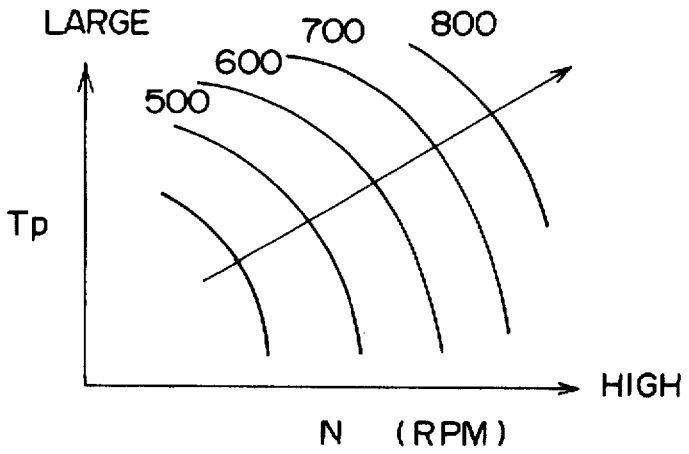
FIG. 3 is a map for estimating the temperature of a catalyst, according to this invention.

In a step S3 it is determined from the output signal from the throttle sensor 9 whether or not the throttle valve 6 is fully closed. If the throttle valve 6 is fully closed then the flow of control is transferred to a step S6, while if it is not fully closed then the flow of control proceeds to a step S4 in which the catalyst temperature $T_{CA}$ is inferred from the basic fuel injection amount Tp and the engine rotational speed N using a map shown in FIG. 3; and then in a step S5 the normal control process for fuel injection is performed.

In the step S6, it is determined whether or not the vehicle running conditions satisfy a predetermined fuel supply cut off condition. This may be, for example, that the gear position and the engine rotational speed N are greater than respective predetermined values.

If the fuel supply cut off condition is not satisfied, then in the step S5 the normal control process for fuel injection is performed. If the fuel supply cut off condition is satisfied, then the flow of control proceeds to a step S7.

In this step S7 the inferred catalyst temperature $T_{CA}$ which was obtained in the step S4 and the temperature value $T_{CH}$ which was set in advance are compared together, and if $T_{CA} \geqq T_{CH}$ then the flow of control proceeds to a step S8. If $T_{CA} < T_{CH}$, then it is considered that the catalyst temperature is low and accordingly the catalyst temperature will not be unduly elevated even if the supply of fuel is cut off, so that there is no risk that the catalyst will be deteriorated. In these circumstances the flow of control is transferred to a step S10 and the fuel supply cut off is performed.

In the step S8, the basic fuel injection amount Tp calculated in the step S2 and the previously set constant value $Tp_{MF}$ are compared together, and if $Tp \geqq Tp_{MF}$ then it is considered that the amount of intake air is sufficient, and even if fuel is supplied there is no risk of misfiring. In these circumstances the flow of control continues to a step S9. In this step S9 fuel injection is performed with the objective of preventing elevation of the temperature of the catalyst, so that rich control of the air/fuel ratio is executed in order to keep the air/fuel ratio on the rich side. Elevation of the temperature of the catalyst is prevented by performing rich control of the air/fuel ratio in this manner if the amount of intake air is sufficient, and deterioration of the catalyst is thereby prevented.

On the other hand if $Tp < Tp_{MF}$ then it is considered that the amount of intake air is insufficient so that there is a danger of misfiring if rich control is performed, and in the step S10 fuel supply cut off is executed. That is, in the situation when the inferred catalyst temperature $T_{CA}$ is high, misfiring due to insufficiency of the intake air can be prevented by not performing rich control of the air/fuel ratio in the event that the amount of intake air has become remarkably low due to poor condition or the like of the supplementary air control valve 8, which preserves the stable operating state of the engine 1. In this case, since the intake air amount is insufficient, even if the fuel supply is cut off in the step S10, the amount of air flowing through the catalytic converter 12 is extremely low, and accordingly the cut off of fuel supply does not invite elevation of the temperature of the catalyst.

Next another embodiment of this invention will be explained with reference to FIG. 4.

The construction of the hardware of this embodiment is the same as that in the previous embodiment described above; only the control algorithm is different.

Figure 2:
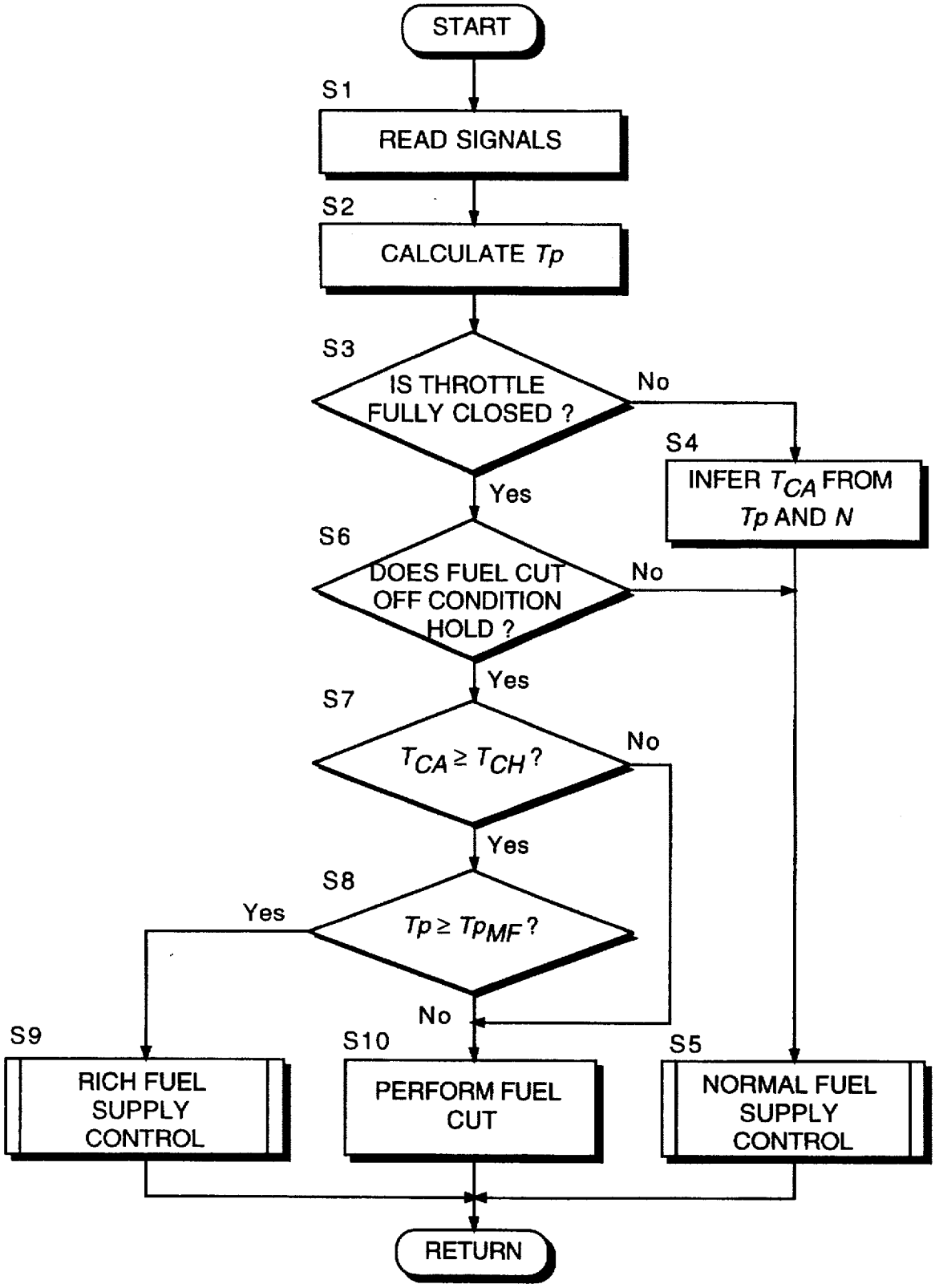
FIG. 2 is a flow chart for explaining a fuel cut off control process according to this invention.
Figure 4:
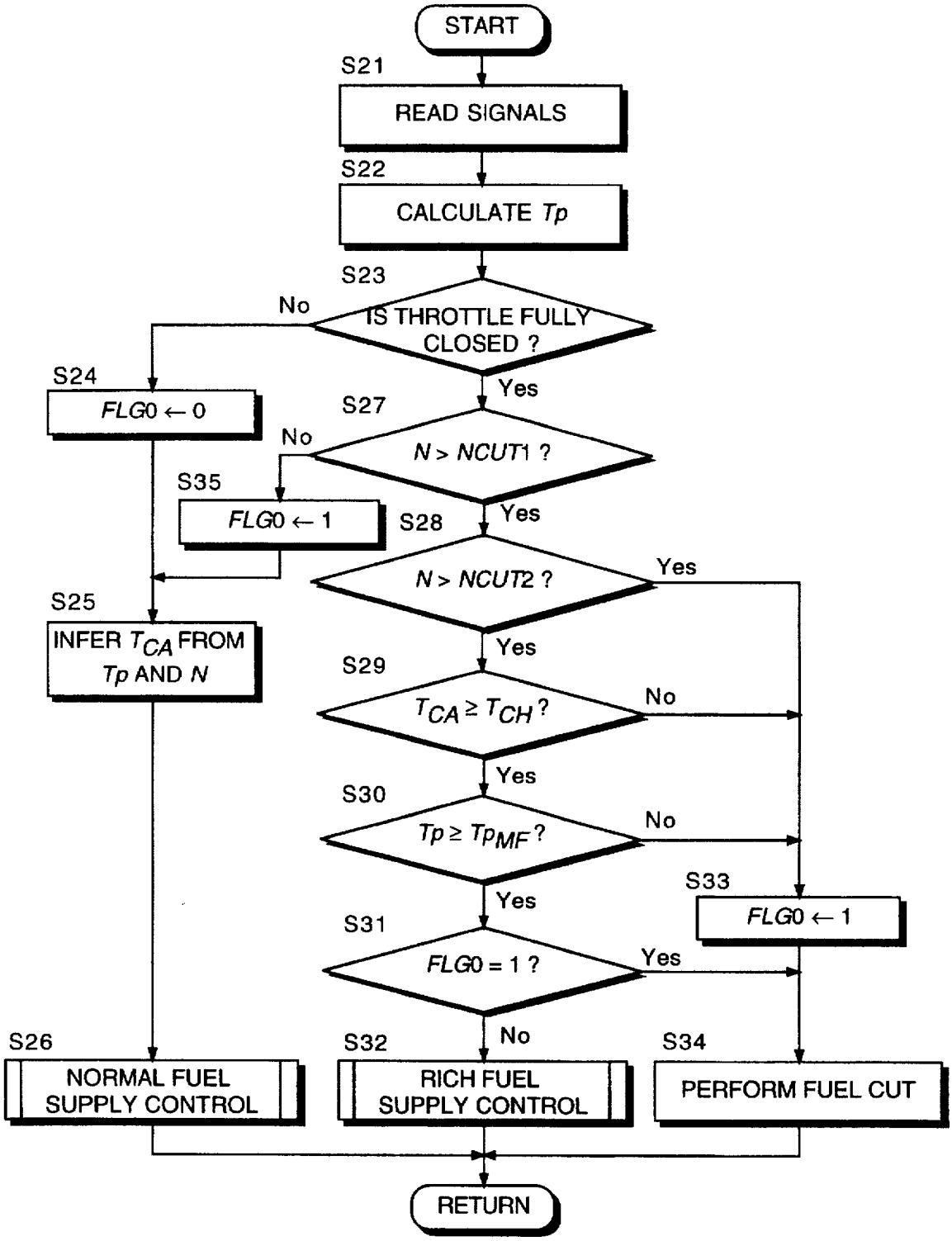
FIG. 4 is similar to FIG. 2, but showing another embodiment of this invention.

The FIG. 4 flow chart corresponds to the FIG. 2 flow chart for the first embodiment. Steps S21, S22, and S23 of FIG. 4 are the same as the steps S1, S2, and S3 of FIG. 2.

In the step S23 the flow of control is transferred to a step S27 if the throttle valve 6 is fully closed. If the throttle valve 6 is not fully closed then the flow of control continues to a step S24, and a flag FLG0 which shows whether or not fuel cut off has been performed is reset to zero, and the flow of control continues to a step S25.

In this step S25, the inferred catalyst temperature $T_{CA}$ is derived from the basic fuel injection amount Tp and the engine rotational speed N, and normal air/fuel ratio control is performed in a step S26.

If the flow of control has been transferred to the step S27, then the engine rotational speed N is compared with a first rotational speed limit value for fuel cut off NCUT1 which is set in advance, and if N>NCUT1 then the flow of control continues to a step S28.

In this step S28 the engine rotational speed N is compared with a second rotational speed limit value for fuel cut off NCUT2 which is set in advance and which is greater than NCUT1.

If $N \leqq NCUT2$ then the flow of control is transferred to a step S29. On the other hand if N>NCUT2 then it is considered that the engine rotational speed N is excessive and the flow of control is transferred to a step S33, in which the flag FLG0 is set to unity, and then in a next step S34 fuel cut off is executed.

In the step S29, the catalyst temperature $T_{CA}$ inferred before deceleration and the constant temperature value $T_{CH}$ which was set in advance are compared together, and if $T_{CA} \geqq T_{CH}$ then the flow of control continues to a step S30. However if $T_{CA} < T_{CH}$ then it is considered that the catalyst temperature is low, so that even if the fuel supply is cut off the catalyst temperature will not become unduly elevated and there is no danger of deterioration of the catalyst. In these circumstances, after the flag FLG1 has been set to unity in the step S33, the fuel supply cut off is performed in the step S34.

If the flow of control has been transferred to the step S30, the basic fuel injection amount Tp and the predetermined value $Tp_{MF}$ are compared together, and if $Tp \geqq Tp_{MF}$ then the flow of control continues to a step S31. If $Tp < Tp_{MF}$ then it is considered that the amount of intake air is insufficient and there is a danger of misfiring if rich control is performed, and in the same way as when the catalyst temperature is low, after the flag FLG1 has been set to unity in the step S33, the fuel supply cut off is performed in the step S34.

If both $T_{CA} \geqq T_{CH}$ and also $Tp \geqq Tp_{MF}$, i.e. the catalyst temperature is high and also the amount of intake air is sufficient, then in the step S31 a decision is taken as to whether or not the flag FLG0 is set to unity. If the value of FLG0 is zero, i.e. fuel cut off has not been performed from when deceleration was started, then the flow of control continues to a step S32 and rich control of the air/fuel ratio is performed. On the other hand, if the value of FLG0 is unity, i.e. if fuel cut off has been performed after the start of deceleration, then without any relation to the conditions for rich control the flow of control proceeds to the step S34 and cut off of the fuel supply is performed.

If in the step S27 it is decided that $N \leqq NCUT1$, then the flow of control is transferred to a step S35 and the value of FLG0 is set to unity, and then the flow of control is transferred to steps S25 and S26, in which, along with inferring the value of the catalyst temperature $T_{CA}$, normal fuel injection control is performed.

In this manner, even if the conditions for rich control are satisfied, if temporarily upon the start of deceleration due to complete closure of the throttle valve fuel cut off has been performed, then rich control is not performed. This is because, if fuel supply cut off has been temporarily performed, the temperature of walls of the combustion chamber has been reduced, and if the combustion of fuel is again restarted in this state then this may easily cause misfiring.

Moreover, it would also be possible to provide a temperature sensor at an inlet of the catalytic converter 12, and to infer the temperature of the catalyst from the temperature at the catalytic converter inlet as detected by this temperature sensor.

The embodiments of this invention in which an exclusive property or privilege is claimed are defined as follows:

1. A fuel supply control device for use with an internal combustion engine, said engine having an intake passage, an exhaust passage, a catalytic converter having a catalyst provided in said exhaust passage, and means for supplying fuel, comprising:

means for cutting off supply of fuel by said fuel supplying means in a predetermined engine deceleration condition;

means for inferring a value for a temperature of said catalyst;

means for detecting an air flow amount in said intake passage;

means for comparing together a value indicative of said inferred catalyst temperature and a previously set first constant value;

means for comparing together the air flow amount in said engine deceleration condition and a previously set second constant value; and means for prohibiting fuel supply cut off by said fuel supply cut off means when said value indicative of said inferred catalyst temperature is greater than said first constant value and also said intake air amount is greater than said second constant value.

2. A fuel supply control device as defined in claim 1, further comprising means for determining whether or not fuel cut off has been performed after the deceleration has started, and means for, if fuel cut off has been performed after the deceleration has started, stopping the prohibition of fuel supply cut off by said prohibiting means until the end of deceleration.

3. A fuel supply control device as defined in claim 2, wherein said catalyst temperature inferring means infers said catalyst temperature from an engine rotational speed and a basic fuel injection amount which is calculated based upon an engine operational condition.

4. A fuel supply control device as defined in claim 1, wherein said catalyst temperature inferring means infers said catalyst temperature before the start of engine deceleration.

5. A fuel supply control device as defined by claim 1, further comprising means for enriching an air/fuel ratio of air-fuel mixture which is supplied to said engine to be richer than a stoichiometric air/fuel ratio, when said value indicative of said inferred catalyst temperature is greater than said first constant value and also said intake air amount is greater than said second constant value.

* * * * *